United States Patent [19]

Skahill

[11] 3,992,816

[45] Nov. 23, 1976

[54] WINDOW TRACKING MECHANISM

[75] Inventor: Richard J. Skahill, Bettendorf, Iowa

[73] Assignee: J. I. Case Company, Racine, Wis.

[22] Filed: July 21, 1975

[21] Appl. No.: 597,419

[52] U.S. Cl. ..... 49/197; 312/323

[51] Int. Cl.[2] ..... E05D 15/38

[58] Field of Search ..... 49/197; 312/307, 296, 312/323

[56] References Cited

UNITED STATES PATENTS

| | | | |
|---|---|---|---|
| 1,855,953 | 4/1932 | Friedrich | 49/197 X |
| 2,031,847 | 2/1936 | Naylor | 49/197 |
| 2,590,028 | 3/1952 | Miller | 312/323 |

*Primary Examiner*—Kenneth Downey

*Attorney, Agent, or Firm*—Arthur J. Hansmann

[57] ABSTRACT

A window tracking mechanism including a window structure and a pair of tracks with rollers rotatable on the tracks and supporting the window structure thereon. The tracks have bends therein for securing the window structure in a lowered position and an upper stored position. One of the rollers is movable, for releasably holding the window structure in either of its two positions.

11 Claims, 3 Drawing Figures

WINDOW TRACKING MECHANISM

This invention relates to a window tracking mechanism, and, more particularly, it relates to an arrangement for movably supporting a window structure which can be positioned between a downwardly closed position and an upper stored position, and it includes mechanism for releasably holding the window in both of those positions.

BACKGROUND OF THE INVENTION

Generally speaking, the prior art is aware of provisions for movably supporting windows and the like on various types and configurations of tracks, such that the window can be moved from a closed position to an open position. In specific prior art classifications, such as in connection with vehicle windows, and particularly including agricultural and tractor vehicle windows, the concern is to have a window which can be positioned in a closed and thereby weather-tight position and which can also be readily moved to an open and thus stored position. In considering these problems and this environment, it is of concern that the entire mechanism be sturdy and that the window be weather-proof and vibration-free in the closed position and also that it be secure and safe in its stored position. That is, it is recognized that a vehicle, such as a tractor cab, is subjected to considerable vibration, all types of weather conditions including dust and moisture conditions, and the tractor cab is also commonly an air-conditioned cab and thus it is important to have the window in an air-tight position when it is in use. Accordingly, it is a primary objective of this invention to accomplish the aforementioned desirable results and to do so with a sturdy and reliable but yet inexpensive mechanism.

Still further, it is an objective of this invention to provide a window structure mechanism which is securely retained in the closed and thus downward position, but it can be readily and easily opened and positioned in a stored position, and, with regard to both of these positions, the mechanism is provided with a locking arrangement to retain the window itself in either position, and the window cannot be moved out of position until the locking mechanism is maneuvered by the operator from the interior of the cab or the like.

Still further, it is an object of this invention to provide a window tracking mechanism which is self-operative with regard to attaining and retaining a secured position wherein the window structure is noise and vibration-free and is weather-tight and is suitable for an air-conditioned enclosure, such as a tractor cab. In accomplishing this objective, the tracking mechanism is arranged as such that the relationship between the window structure itself and the arrangement of tracks for guiding the window structure is such that the window structure will achieve the weather-tight and noise-dampening condition desired.

Still another objective of this invention is to provide an improved and simplified window tracking mechanism, compared to those heretofore known, and to include a securing mechanism which is useful in securing the window in both a closed position and a stored position.

Other objects and advantages will become apparent upon reading the following description in light of the accompanying drawings.

DETAILED DESCRIPTION OF THE PREFERRED EMBODIMENT

Figure 1:
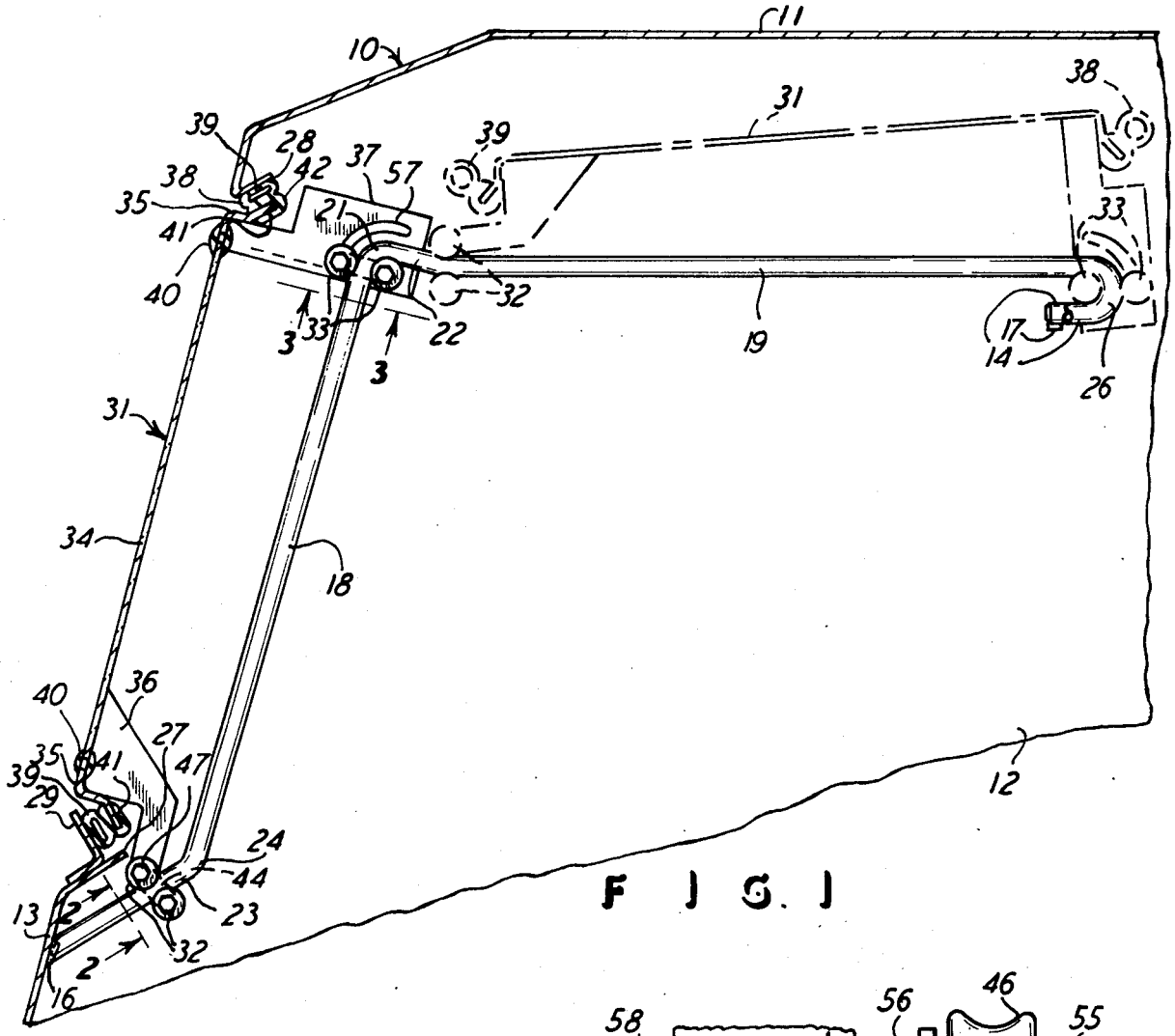
FIG. 1 is a side view of the window tracking mechanism of this invention, partly in section.

The window tracking mechanism of this invention is particularly suitable for use in a tractor cab, such as that used in agricultural and construction vehicles. Accordingly, FIG. 1 generally shows a tractor cab 10 which has a roof 11 which spans cab sides, such as the shown side 12, and there is also a cab rearward portion 13 which is disposed at the rear of the cab 10 and extends thereacross. A pair of tracks 14, in the form of bent rods, as shown, are mounted in the cab 10, and they may be secured at their ends at locations designated 16 and 17, in any suitable manner. Thus there are two tracks or rods 14 which extend in the cab 10 and are spaced apart such that each rod 14 may extend adjacent a cab side 12, for instance.

Each rod 14 includes the generally uprightly disposed portion or length 18 and the generally horizontally disposed portion or length 19, and the portions 18 and 19 extend to and are connected by the portion 21 which is a bend of an arcuate shape, as shown in FIG. 1. Also, each rod 14 has the portion 22 which is an end portion to the horizontal portion 19, such that the end portion 22 is directed slightly upwardly relative to the remainder of the portion 19, as shown in FIG. 1 and for a purpose hereinafter described. Also, the two rods 14 have lower ends or portions 23 which are disposed at an angle relative to the upright portions 18, and there is a bend 24 contiguous with and extending between portions 18 and 23, as shown in FIG. 1. Finally, each rod 14 has a semicircular bend portion 26 contiguous with and at the end of the portion 19, as also shown in FIG. 1.

Figure 2:
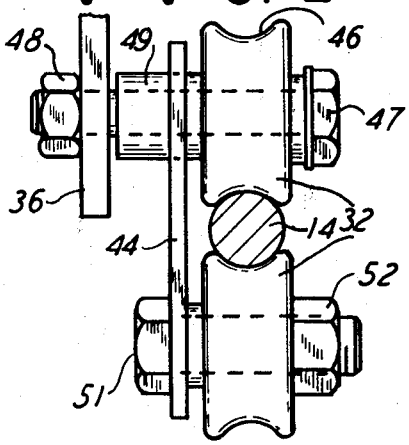
FIGS. 2 and 3 are enlarged sectional views taken respectively on the lines 2—2 and 3—3 of FIG. 1.
Figure 3:
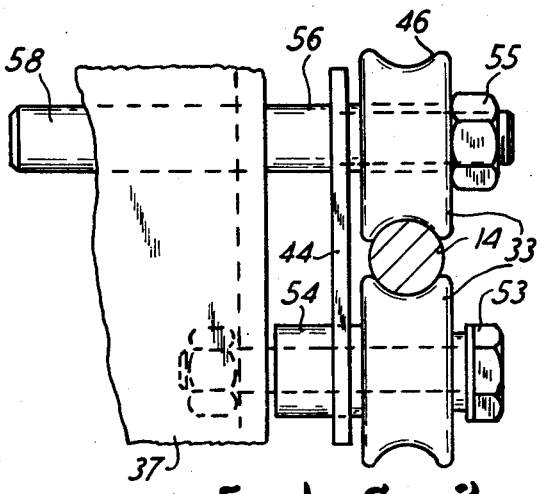

Thus it will be seen and understood that rods 14 form parallel tracks and are of a circular cross section, as more clearly shown in FIGS. 2 and 3, throughout the length of the rods 14, and thus the rod horizontal portions 19 extend beneath the cab roof 11 and substantially parallel thereto, and the rod upright portions 18 extend at the rearward portion of the cab 10. Further, the cab 10 itself presents a window opening which is defined by the terminal end 27 of the cab portion 13 and the abutment or surface 28 of the cab roof 11. Also, an abutment member 29 is suitably affixed to the cab portion 13 and extends at the angle shown in FIG. 1, and also the portion 28 extends at its angle shown in FIG. 1 and along the sides of the opening, all for a purpose hereinafter described.

A window structure 31 is movably supported on the tracks 14 by means of pairs of rollers 32 and 33, and it will be understood that there are a total of four pairs of rollers 32 and 33 which respectively engage the tracks 14, and FIG. 1 shows only one of each of the two pairs. The window structure 31 has a glass piece 34, and an endless frame 35 extends around the glass 34 and is shaped as shown in FIG. 1 and extends endless along the endless abutment of the pieces 28 and 29. Also, the window structure has a bracket 36 which is suitably connected to and extends between the frame 35 and the lower two pair of rollers 32, and the window structure 31 also has a connector 37 which is suitably affixed to and extends from the frame 35 and supports the two upper pair of rollers 33. Thus the entire window structure 31 is movably supported on the rods 14 by means of the four pair of rollers 32 and 33, as shown and described.

With the arrangement as shown in the drawings, and considering the description to this point, it should be seen and understood that there is the window structure 31 which is movably supported on the rods 14 to be positioned between the secured or lowered position shown in the solid lines in FIG. 1, and that is the position where the structure 31 is presenting a closure for the cab opening defined by the pieces 28 and 29. It will also be seen and understood that the structure 31 may be moved to an open or stored position which is shown by the dot-dash lines in FIG. 1 where the structure 31 is then resting on and adjacent to the track lengths 19. With this arrangement, the structure 31 can therefore be positioned to close the window opening, as shown by the solid lines, and it can be readily and easily moved to the stored position, as shown by the dot-dash lines.

It will also be seen and understood that the window structure 31 has an elastomeric strip 38 secured endlessly around the edge of the frame 35, as shown. That is, the outer edge of the frame 35 is embedded in the strip portions 42 to be permanent therewith, and the strip 38 has resilient portions 39 which respectively engage the abutments 28 and 29 to be noise and dust and weather-proof with the respective abutments. Also, an elastic strip 40 has the edges of the glass 31 and frame 35 embedded therein. At this time it will also be now seen and understood that the endless frame 35 has its endless edge 41 disposed at an angle when the window structure 31 is in the closed position, and thus the strip 38 is in full abutting contact with the abutments 28 and 29 which are therefore disposed at angles related to the angulation of the rods 14 at their portions adjacent 21 and at 23. That is, since the window structure 31 moves according to the configuration of the rods 14, the rods 14 are formed with the portions 21 and 23 to thereby move the window structure 31 such that the weatherproof strip 38 will respectively move in the direction of the abutments 28 and 29, when the structure 31 moves to its lowered position shown in FIG. 1, and thus the strip 38 is weather-proof relative to the angulated abutment portions 28 and 29. The dot-dash showing of the weather strip 38 shows the free-body position of the strip 39 prior to being compressed by the securing of the window structure 31 as it is guided by the rods 14, as described above with relation to the rod portions 21 and 23, and thus the weather strips are compressed against the abutments 28 and 29, by the relationship of the frame edge 41 and the rods and the rollers, which relationship moves the structure 31 toward pieces 28 and 29.

All four pairs of rollers 32 and 33 are connected together by links 44 which keep the respective rollers in opposed positions relative to the rods 14. Thus, FIGS. 2 and 3 show the respective rollers 32 and 33 to have concaved circumferences 46 which conform to the circular cross section of the rods 14 to be snug therewith and with the respective pairs of rollers spaced apart a distance sufficient to snugly engage opposite sides of the rods 14. Particularly, FIG. 2 shows the rollers 32 with one of the rollers supported on a bolt 47 which is a roller axle and is connected to the bracket 36 by the nut 48, and a spacer 49 is used to position the one roller 32, as shown in FIG. 2. Then the link 44 is pivoted on the spacer 49 and extends therefrom to support a bolt 51 which is a roller axle and which rotatably supports the other roller 32 which is secured to the bolt 51 by means of the nut 52.

FIG. 3 shows an arrangement for the rollers 33, and here it will be seen that the bracket 37 receives a bolt 53 which rotatably supports the lower one of the rollers 33, and a spacer 54 extends between the bracket 37 and the roller 33 and pivotly supports the link 44. A shaft 56 also engages the bracket 37, by means of extending through a quarter arc slot 57 shown in FIG. 1, and the shaft 56 rotatably supports the upper roller 33, and a nut 55 holds the roller on the shaft 56. With this arrangement, the link 44 permits the upper roller 33 to be swung between the limit positions of the shaft 56 in the slot 57, and it will also be seen that the slot 57 is of a similar curvature to the curvature 21 of the rods 14, and FIG. 1 shows those two curvatures to actually be concentric, and that concentricity is substantially about the axis of the bolt 53. Thus, the shaft 56 has an extending end 58 which is a handle portion of the shaft 56 and is available for the operator to move the upper roller 33 to positions corresponding to opposite ends of the arcuate slot 57 in the bracket 37.

With the arrangement shown and described, it should therefore be understood that the window structure 31 can be positioned in its solid line lowered position shown in FIG. 1. In that position, the two pairs of rollers 33 are arranged so that the shaft 56 is in the lower end of the slot 57 and thus the rollers 33 lock and secure the window structure 31 in its lowered position, since the structure 31 cannot be raised and moved along the rods 14, by virtue of the lower one of the rollers 33 being in abutting contact with the rod portion 22 which thus prevents raising of the window structure 31. However, when it is desired to place the window structure 31 in the dot-dash line stored position shown in FIG. 1, then the operator can grasp the handle 58 and move it in the slot 57 and to the other end of the slot so that the upper roller 33 is then in a position above the rod portion 22, rather than in its position shown in FIG. 1, and then the entire window structure 31 can be moved to the dot-dash line position of FIG. 1. In the dot-dash line secured position of FIG. 1, the upper roller 33 is in a position corresponding to the position of the shaft 56 in one end of the slot 57, and thus the rollers 33 are on opposite sides of the rod bend or arcuate portion 26, and therefore the window structure 31 cannot move until the operator again moves the shaft 56 to a position which will swing the upper one of the rollers 33 to the top of the horizontal portion 19. That is, the dot-dash line position of FIG. 1 shows the rollers 33 in the secured or latched position by virtue of having the rollers flanking the rod arcuate portion 26, and thus the structure 31 cannot move in any direction. It will also be noticed that the spacing between the pairs of rollers 32 and 33 along the rods 14 is such that the upper rollers 33 are in the FIG. 1 position to abut the portion 21, and thereby preclude raising of the structure 31 in the solid line position while the rollers 32 are on the rod angulated portion 23; and the spacing between the pairs of rollers 32 and 33 is such that the rollers respectively engage the portions 22 and 26 of the rods 14 in the stored position, and thereby preclude movement of the window structure 31 until the operator maneuvers the handle 58.

What is claimed is:

1. A window tracking mechanism comprising a window structure, a pair of spaced-apart and parallel tracks with each thereof having a bend therein at the same location along the length of said tracks, pairs of rollers rotatably supported on said window structure and with each pair of rollers having its rollers disposed in rolling contact with and on opposite sides of a respective one of said tracks for movably supporting said structure on said tracks, and a movable link connected between said rollers of one of said pairs of rollers to have one roller of said pair of rollers movably supported on said window structure for movement along said bend and relative to the other roller of said one pair of rollers for positioning said one roller relative to said bend to releasably restrain movement of said one pair of rollers along said track and thereby releasably secure said window structure relative to said tracks.

2. The window tracking mechanism as claimed in claim 1, including a handle connected with said one roller for moving said one roller along said bend.

3. The window tracking mechanism as claimed in claim 1, wherein said tracks extend in an upright portion and a horizontally disposed portion and said bend is located intermediate said portions, and said one pair of rollers is movable along said bend and to and from said upright portion and said horizontally disposed portion, and said window structure has a track and said one roller is operatively associated with said structure track to be guided thereby and directed along said bend for securing and releasing said window structure.

4. The window tracking mechanism as claimed in claim 3, wherein said structure track is a slot curved similar to the curvature of said bend, and a handle connected with said one roller and extending into said slot for guiding said one roller along said bend.

5. The window tracking mechanism as claimed in claim 1, wherein said one pair of rollers is connected together, and said one roller is arranged to be movable about the axis of the other of said rollers.

6. The window tracking mechanism as claimed in claim 1, including an abutment disposed adjacent said tracks, and said window structure having a surface matched with said abutment and in contact therewith in the secured position of said window structure, said abutment and said surface presenting a cushioned and weather-tight contact therebetween.

7. The window tracking mechanism as claimed in claim 1, wherein said tracks include an upright extent and angled portions extending toward the horizontal at both the upper and lower ends of the upright extent, an abutment disposed adjacent and facing each said upright extent and presenting an endless surface defining the window opening and said window structure having an endless surface matching and in contact with said abutment when said window structure is supported on said upright extent.

8. The window tracking mechanism as claimed in claim 1, wherein said tracks both have an additional bend therein at locations on said tracks spaced from the first said bend a distance corresponding to the spacing of said pairs of rollers along said tracks, whereby said one pair of rollers engages said additional bend and thereby retain said window structure in position on said additional bend.

9. The window tracking mechanism as claimed in claim 1, wherein said tracks include an upright portion and a horizontal portion and said bend being disposed intermediate said portions, said window structure and both said portions being substantially the same length whereby said window portion extends along the full length of each of said portions in respective positions of said window structure on said portions, and said horizontal portion presenting a stored position for said window structure.

10. The window tracking mechanism as claimed in claim 9, including a second bend in said tracks and located contiguous with said horizontal portion at a location spaced from the first said bend and at the end of said horizontal portion, for receiving said one pair of rollers in a stored position of said window structure.

11. A window tracking mechanism comprising a window structure, a pair of spaced-apart and parallel tracks with each thereof having a bend therein at the same location along the length of said tracks, pairs of roller axles supported on said window structure and extending on opposite sides of each of said tracks, rollers rotatably supported on each of said axles and disposed in rolling contact with and on the two opposite sides of a respective one of said tracks for movably supporting said structure on said tracks, a link connected between a pair of said axles and being swingably mounted on one axle of said pair for movement of said roller on the other axle of said pair of said axles and along said bend and relative to the said roller on the said one axle, for positioning said roller on said other axle relative to said bend to releasably restrain movement along said track of said rollers on said pair of axles and thereby releasably secure said window structure relative to said tracks.

* * * * *